US009818275B2

(12) United States Patent
Sayegh et al.

(10) Patent No.: US 9,818,275 B2
(45) Date of Patent: Nov. 14, 2017

(54) MOBILE APPARATUS FOR NEUTRALIZING ANTI-THEFT DEVICES

(71) Applicant: USS Technologies, LLC, Rancho Cucamonga, CA (US)

(72) Inventors: Adel O. Sayegh, Rancho Cucamonga, CA (US); Anthony Oliver, Rancho Cucamonga, CA (US); Edgardo M. Redublo, Chino Hills, CA (US); Marc Trincale, Rancho Cucamonga, CA (US); Xiafeng Rao, Hangzhou (CN)

(73) Assignee: USS Technologies, LLC, Rancho Cucamonga, CA (US)

( * ) Notice: Subject to any disclaimer, the term of this patent is extended or adjusted under 35 U.S.C. 154(b) by 187 days.

(21) Appl. No.: 14/341,386

(22) Filed: Jul. 25, 2014

(65) Prior Publication Data

US 2015/0029028 A1 Jan. 29, 2015

Related U.S. Application Data

(60) Provisional application No. 61/859,207, filed on Jul. 27, 2013.

(51) Int. Cl.
*G08B 13/14* (2006.01)
*G08B 13/24* (2006.01)

(52) U.S. Cl.
CPC ..... *G08B 13/242* (2013.01)

(58) Field of Classification Search
CPC G08B 13/244; G08B 13/2411; G08B 13/242; G08B 13/246; G08B 13/2462; G08B 13/2477; G08B 21/24; G07G 1/0081
See application file for complete search history.

(56) References Cited

U.S. PATENT DOCUMENTS 5,920,262 A 7/1999 Copeland
6,700,489 B1 * 3/2004 Easter ..... G08B 13/242 235/472.01
6,967,578 B1 * 11/2005 Guida ..... G08B 13/2411 235/462.45
8,439,263 B2 * 5/2013 Clark ..... G08B 13/2462 235/462.01
2004/0046027 A1 * 3/2004 Leone ..... G06K 7/10 235/462.13
2007/0011919 A1 * 1/2007 Case ..... A43B 1/0036 36/132
2008/0297349 A1 * 12/2008 Leone ..... G08B 13/2477 340/572.1
2009/0229327 A1 9/2009 Valade, Jr.
2010/0188227 A1 * 7/2010 Yang ..... G08B 13/1463 340/572.1
2012/0322587 A1 * 12/2012 Duke ..... A63B 69/0071 473/450
2013/0069499 A1 * 3/2013 Modrell ..... G06F 1/1656 312/223.1
2013/0134061 A1 * 5/2013 Wu ..... G06F 1/1626 206/320
2014/0085089 A1 * 3/2014 Rasband ..... G08B 13/246 340/572.1
2015/0243157 A1 * 8/2015 Choi ..... E05B 73/0005 340/571

* cited by examiner

*Primary Examiner* — George Bugg
*Assistant Examiner* — Renee Dorsey
(74) *Attorney, Agent, or Firm* — Milord A. Keshishian

(57) ABSTRACT

Invention provides a wearable neutralizer apparatus for neutralizing anti-theft devices.

50 Claims, 18 Drawing Sheets

MOBILE APPARATUS FOR NEUTRALIZING ANTI-THEFT DEVICES

CROSS-REFERENCE TO RELATED APPLICATIONS

This Application claims the benefit of priority of the U.S. Utility Provisional Patent Application No. 61/859,207, filed Jul. 27, 2013, the entire disclosure of which is expressly incorporated by reference.

It should be noted that where a definition or use of a term in the incorporated patent application is inconsistent or contrary to the definition of that term provided herein, the definition of that term provided herein applies and the definition of that term in the incorporated patent application does not apply.

BACKGROUND OF THE INVENTION

Field of the Invention

One or more embodiments of the present invention relates to an apparatus for neutralizing anti-theft devices (e.g., Electronic Article Surveillance (EAS) devices) and, more particularly, to an apparatus for neutralizing anti-theft devices that is mobile while secure from unauthorized use.

Description of Related Art

Conventional anti-theft detachers and anti-theft deactivators are well known and have been in use for a number of years. Anti-theft detachers are generally used to neutralize anti-theft tags (e.g., EAS tags) to facilitate detachment and removal of the tag from an article to which the tag is coupled without triggering an alarm. The anti-theft deactivators are generally used to neutralize anti-theft labels (or EAS labels), making the labels deactivated so that articles may be removed from a retail store without triggering an EAS system alarm.

Most conventional detachers and deactivators are on purpose made stationary so that they are not removed, stolen, or lost. In general, they are permanently fixed and mounted and installed onto a surface of a stationary Point of Sale (POS) structure such as a cash wrap or a checkout counter. Access to lost or stolen detacher and or deactivator by an unauthorized individual will allow unauthorized neutralizing of anti-theft devices, facilitating their unauthorized detachment from articles or their unauthorized deactivation.

Most of today's retail environments use well-known conventional mobile POS devices to conduct a transaction, which may be far away from any POS structure to which most conventional detachers and or deactivators are coupled. For example, a sales associate at a large departments store may carry a mobile POS device and conduct an on-the-spot transaction at a location within a department store that may be far away from the POS structure that has the attached detacher or deactivator. Accordingly, the mobile POS devices provide the convenience of not having to walk to a permanent, stationary POS area to conduct an actual transaction but unfortunately, once a transaction is completed (using mobile or stationary POS devices), in today's environment, the consumer and the sales associate must still walk up to a permanently located detacher and or deactivator (a stationary surface mounted detacher and or deactivator) to neutralize and remove the attached anti-theft tag or deactivate the anti-theft label, which negates the convenience and purpose of using mobile POS systems.

Accordingly, in light of the current state of the art and the drawbacks to current detachers and deactivators mentioned above, a need exists for a mobile apparatus for neutralizing anti-theft tags and or labels on the spot and at a mobile POS location while secure from unauthorized use.

BRIEF SUMMARY OF THE INVENTION

A non-limiting, exemplary aspect of an embodiment of the present invention provides an apparatus, comprising a wearable neutralizer for neutralizing anti-theft devices.

Another non-limiting, exemplary aspect of an embodiment of the present invention provides an apparatus for neutralizing an anti-theft device, comprising one or more neutralizing member associated with a wearable support, forming a secured, wearable neutralizing apparatus that is mobile.

Still another non-limiting, exemplary aspect of an embodiment of the present invention provides an apparatus for neutralizing an anti-theft device, comprising a housing for accommodating one or more neutralizing member; the housing associated with a wearable support, forming a secured, wearable neutralizing apparatus that is mobile.

Such stated advantages of the invention are only examples and should not be construed as limiting the present invention. These and other features, aspects, and advantages of the invention will be apparent to those skilled in the art from the following detailed description of preferred non-limiting exemplary embodiments, taken together with the drawings and the claims that follow.

BRIEF DESCRIPTION OF THE DRAWINGS

It is to be understood that the drawings are to be used for the purposes of exemplary illustration only and not as a definition of the limits of the invention. Throughout the disclosure, the word "exemplary" may be used to mean "serving as an example, instance, or illustration," but the absence of the term "exemplary" does not denote a limiting embodiment. Any embodiment described as "exemplary" is not necessarily to be construed as preferred or advantageous over other embodiments. In the drawings, like reference character(s) present corresponding part(s) throughout.

DETAILED DESCRIPTION OF THE INVENTION

The detailed description set forth below in connection with the appended drawings is intended as a description of presently preferred embodiments of the invention and is not intended to represent the only forms in which the present invention may be constructed and or utilized.

One or more embodiments of the present invention provide a mobile apparatus for neutralizing anti-theft devices at a POS location (stationary or mobile) while secure from unauthorized use. Another of one or more embodiments of the present invention provide a wearable apparatus (and hence, also mobile) for neutralizing anti-theft devices at a POS location (stationary or mobile) while secure from unauthorized use. Accordingly, the apparatus provided by the present invention may be carried by an authorized user for neutralizing anti-theft devices at any POS location (mobile or stationary). Therefore, once a transaction is completed (using mobile or stationary POS devices), the consumer and the sales associate need not walk up to a permanently located detacher and or deactivator to neutralize and remove an attached anti-theft device. Using the apparatus in accordance with one or more embodiments of the present invention, the sales associate may neutralize and remove the attached anti-theft tags or deactivate the anti-theft labels on the spot at the POS location while maintaining the apparatus secure from unauthorized use. Another aspect of the apparatus comprises electronic components (passive and or active) that may function as conventional Radio Frequency Identification (RFID) or provide other electronic functionality that enable association of the apparatus of the present invention with external devices. Non-limiting examples of "association" may include communication, transmission/receipt of signals, etc. Non-limiting examples of external devices may include any device capable of receiving or transmitting signals, including mobile devices, alarm system, computers, etc.

Figure 1A:
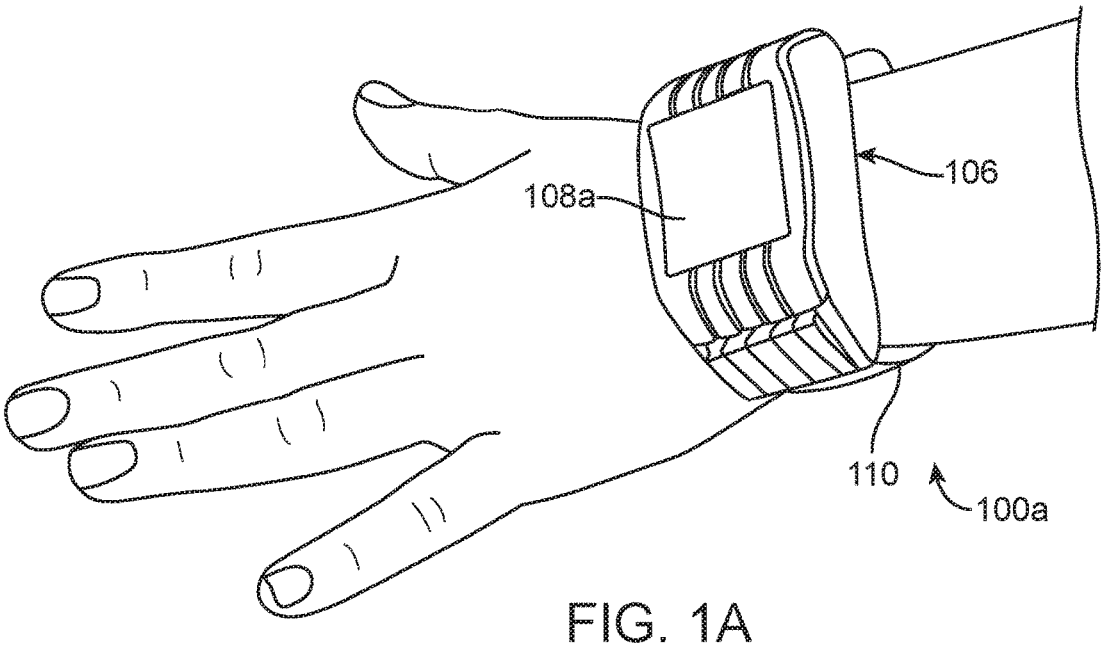
FIGS. 1A to 1C are non-limiting exemplary illustrations of an apparatus for neutralizing anti-theft devices in accordance with one or more embodiments of the present invention.
Figure 1B:
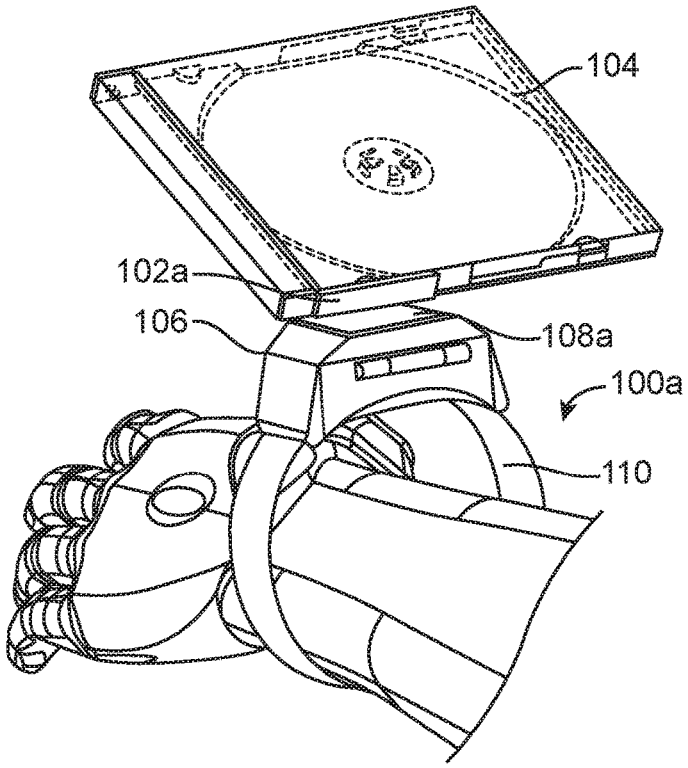
Figure 1C:
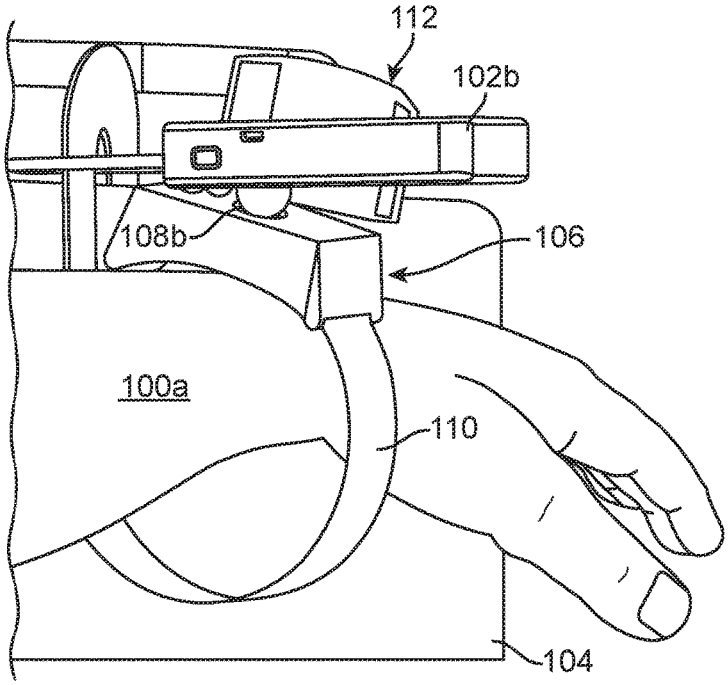

FIGS. 1A to 1C are non-limiting exemplary illustrations of an apparatus for neutralizing anti-theft devices in accordance with one or more embodiments of the present invention. As illustrated in FIGS. 1A to 1C, the present invention provides an apparatus in a form of a wearable neutralizer 100*a* for neutralizing anti-theft devices 102. Non-limiting, non-exhaustive listing of examples of anti-theft devices may include, for example, Electronic Article Surveillance (EAS) labels 102*a* (FIG. 1B), EAS tags 102*b* (FIG. 1C), etc.

Apparatus 100*a* for neutralizing anti-theft devices 102 is comprised of a portable housing 106 for accommodating one or more neutralizing member 108, with portable housing 106 adapted to be securely associated with a user, forming mobile neutralizing apparatus 100*a* while secure from loss or theft. In this non-limiting exemplary instance, portable housing 106 is securely configured to be worn by an authorized user. That is, the portable housing 106 is associated with a wearable support 110 that secures the apparatus 100*a* to an authorized user. The methods of associating wearable support 110 with housing 106 is too numerous to enumerate and may depend on many other factors that may include without limitation, the type of wearable support 110 used (e.g., a belt, a wristband, necklace, bracelet, lanyard, keychain, belt buckle, etc.) that is associated with portable housing 106, with each type having a large number of variety of methods of coupling with portable housing 106. In other words, wearable support 110 may take on any form (including a shirt, uniform, etc. that may include a pocket that securely accommodates housing 106) without affecting the inventive aspect of the present invention so long as wearable support 110 secures apparatus 100*a* to an authorized user. It should further be noted that wearable support 110 should not be limited to attaching apparatus 100*a* to a user, by may also facilitate attachment of apparatus 100*a* to an object on the user.

As illustrated in FIG. 1B, apparatus 100*a* of the present invention may include an EAS deactivator pad 108*a* as one of the one or more neutralizing member 108 where authorized users may use to deactivate EAS labels 102*a* associated with an article 104. As illustrated in FIG. 1C, apparatus 100*a* of the present invention may further include an EAS detacher 108*b* (under cover 112) as another of one or more neutralizing member 108 where authorized users may use to deactivate, detach, and remove an EAS tag 102*b* from article 104. In both instances, once a transaction is completed (using mobile or stationary POS devices), using mobile apparatus 100*a* in accordance with one or more embodiments of the present invention, the authorized user may neutralize and remove attached EAS tags 102*b* or deactivate EAS labels 102*a* on the spot at the POS location while maintaining mobile apparatus 100*a* secure from unauthorized use. In particular, the authorized users may simple use EAS deactivator pad 108*a* to contact EAS label 102*a* of article 104 (as exemplarily shown in FIG. 1B) or use EAS detacher 108*b* to contact the appropriate portion of EAS tag 102*b* (as exemplarily shown in FIG. 1C) to neutralize them.

Figure 2A:
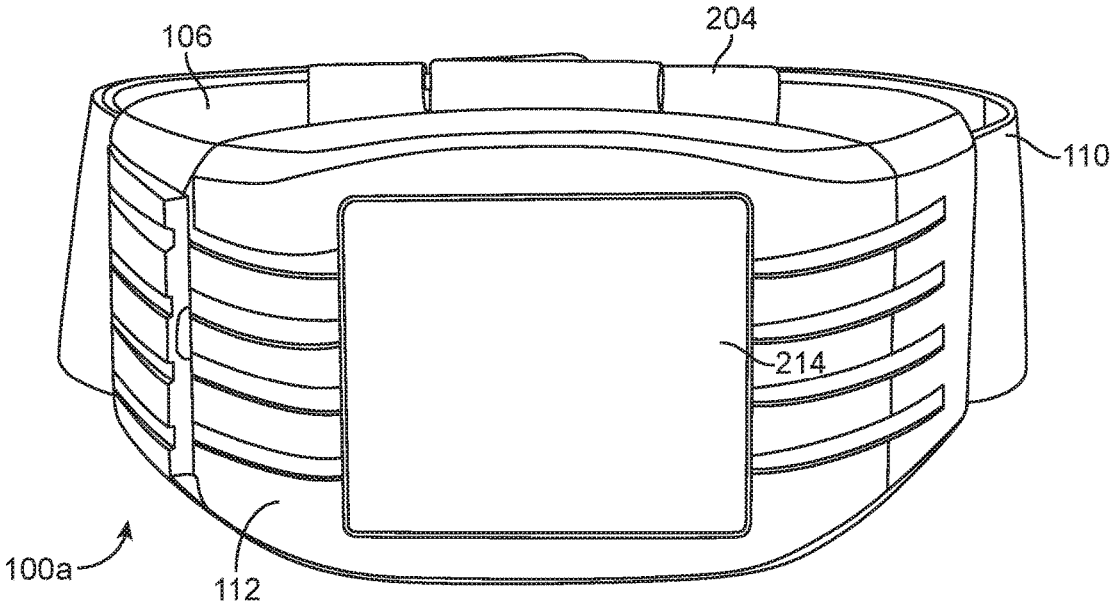
FIGS. 2A to 2C are non-limiting, exemplary illustrations of various views of the apparatus for neutralizing anti-theft devices shown in FIGS. 1A to 1C in accordance with an embodiment of the present invention, with FIG. 2C illustrating the same, but with a cover in an open position.
Figure 2B:
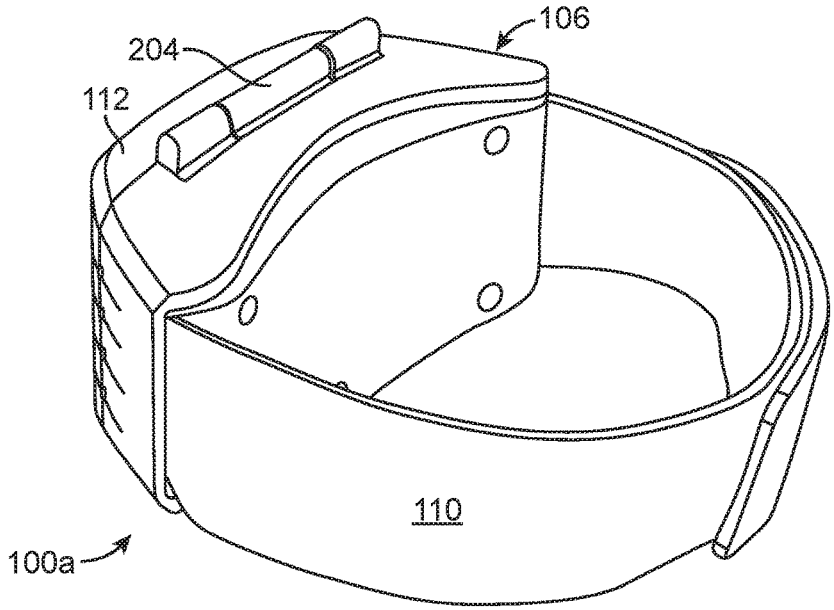
Figure 2C:
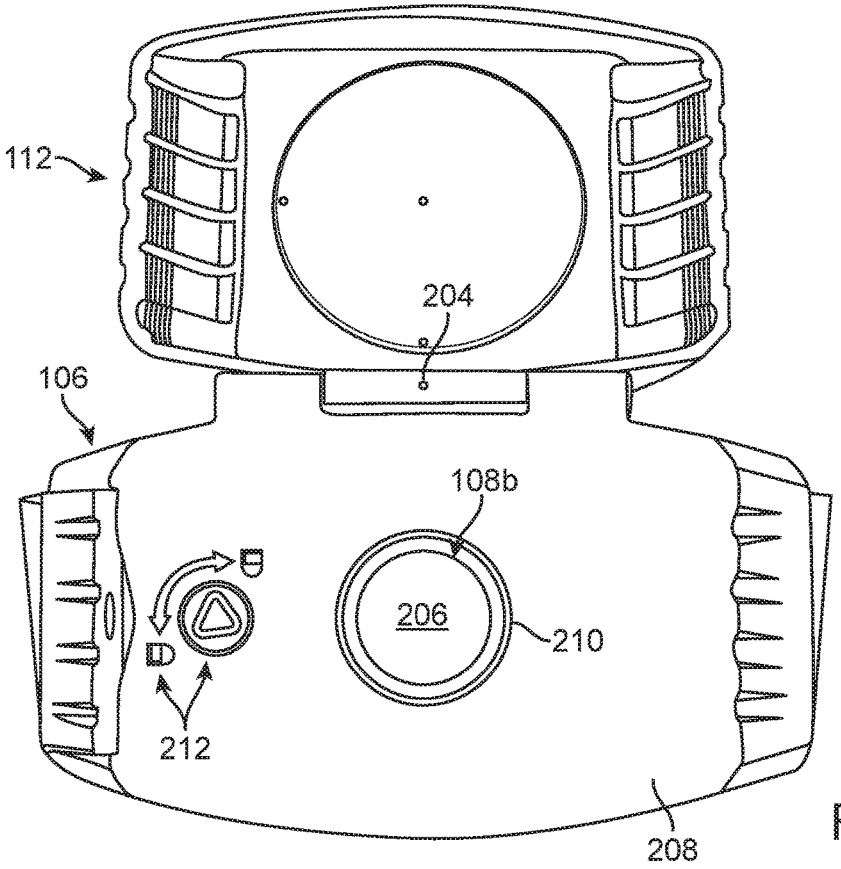

FIGS. 2A to 2C are non-limiting, exemplary illustrations of various views of the apparatus for neutralizing anti-theft devices shown in FIGS. 1A to 1C in accordance with an embodiment of the invention, with FIG. 2C illustrating the same, but with a cover in an open position in accordance with an embodiment of the present invention. As illustrated in FIGS. 1A to 2C, apparatus 100*a* for neutralizing anti-theft devices 102 includes a cover 112 associated with housing 106. Cover 112 may comprise of any design and or form and may be associated with housing 106 in a variety of manners too numerous to enumerate. A non-limiting example of associating cover 102 with housing 106 is the use of a hinge mechanism 204 as shown, other examples may include a sliding mechanism that slide cover 112 to one of an open or closed positions.

Cover 112 in a closed position (FIGS. 2A and 2B) impedes and reduces an engagement strength of one or more neutralizer 108 with objects by covering over engagement surface 206 of one or more neutralizer 108. In this non-limiting, exemplary instance, neutralizer 108 is in a form of an exemplary EAS detachers 108*b*, which may comprise of a strong magnet. When in closed position, cover 112 reduces the magnetic filed strength of EAS detacher 108*b* experienced outside the cover to thereby reduce the pull of EAS detacher 108 towards magnetic objects. The closed arrangement of cover 112 provides protection against unintended or accidental pull of metal objects drawn to apparatus 100*a* due to the magnetic field strength of neutralizer 108*b*. As further detailed below, housing 206 includes a top side surface 208 that has an optional engagement opening 210, with engagement surface 206 of neutralizer 108*b* exposed through engagement opening 210, with engagement opening 210 allowing direct access to exposed surface 206 of neutralizer 108*b*. It should be noted that the use of engagement opening 210 depends on material and thickness of top side surface 208 and therefore, may not be necessary. Cover 112 in an open position (FIGS. 1C and 2C) enables access to engagement surface 206 of neutralizer 108*b*. Accordingly and as detailed below, cover 112 enables selective engagement of neutralizer 108 with anti-theft device 102. As further detailed below and best shown in FIG. 2A, in addition to providing protection, cover 112 also accommodates neutralizer 108*a* that may be a deactivator in a form of a deactivator pad 214 for deactivating EAS label 102*a*. FIG. 2B further illustrates an embedded electronic module such as an RFID.

Figure 3A:
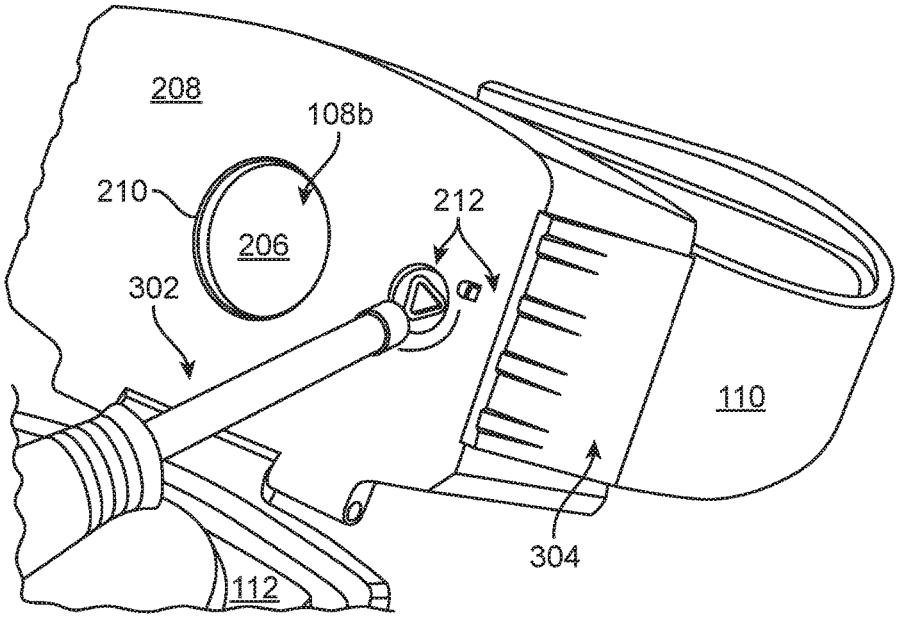
FIGS. 3A to 3F are non-limiting exemplary illustrations of the various views of the apparatus for neutralizing anti-theft devices shown in FIGS. 1A to 2C, showing the locking mechanism in accordance with an embodiment of the present invention.
Figure 3B:
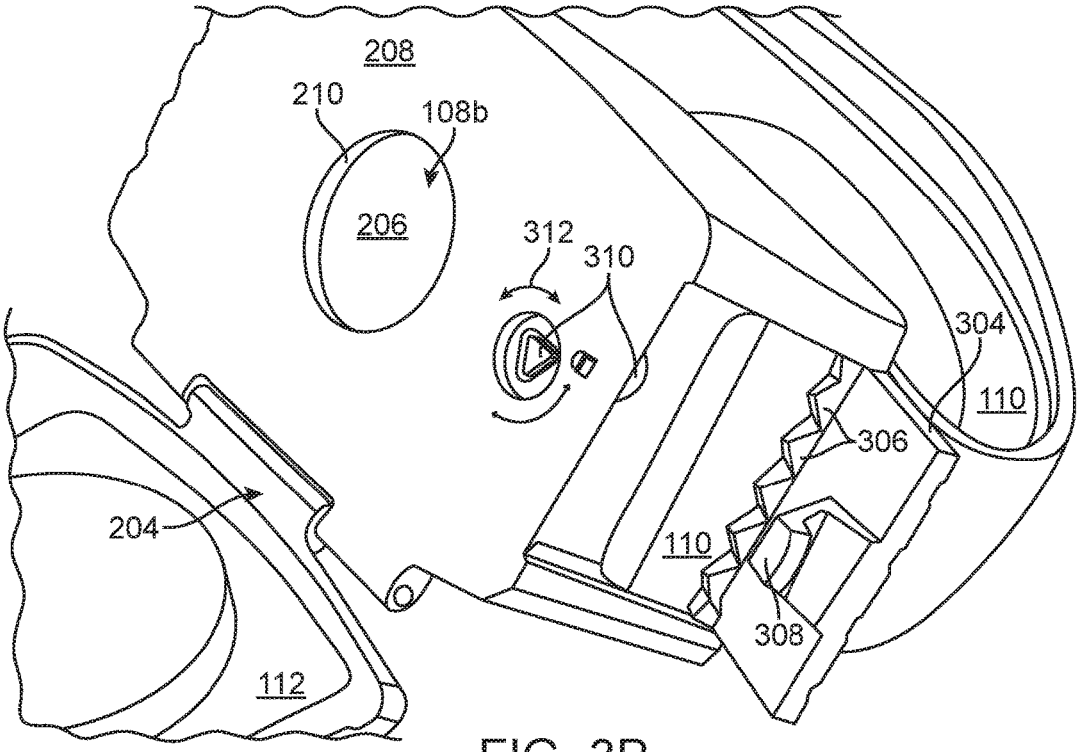
Figure 3C:
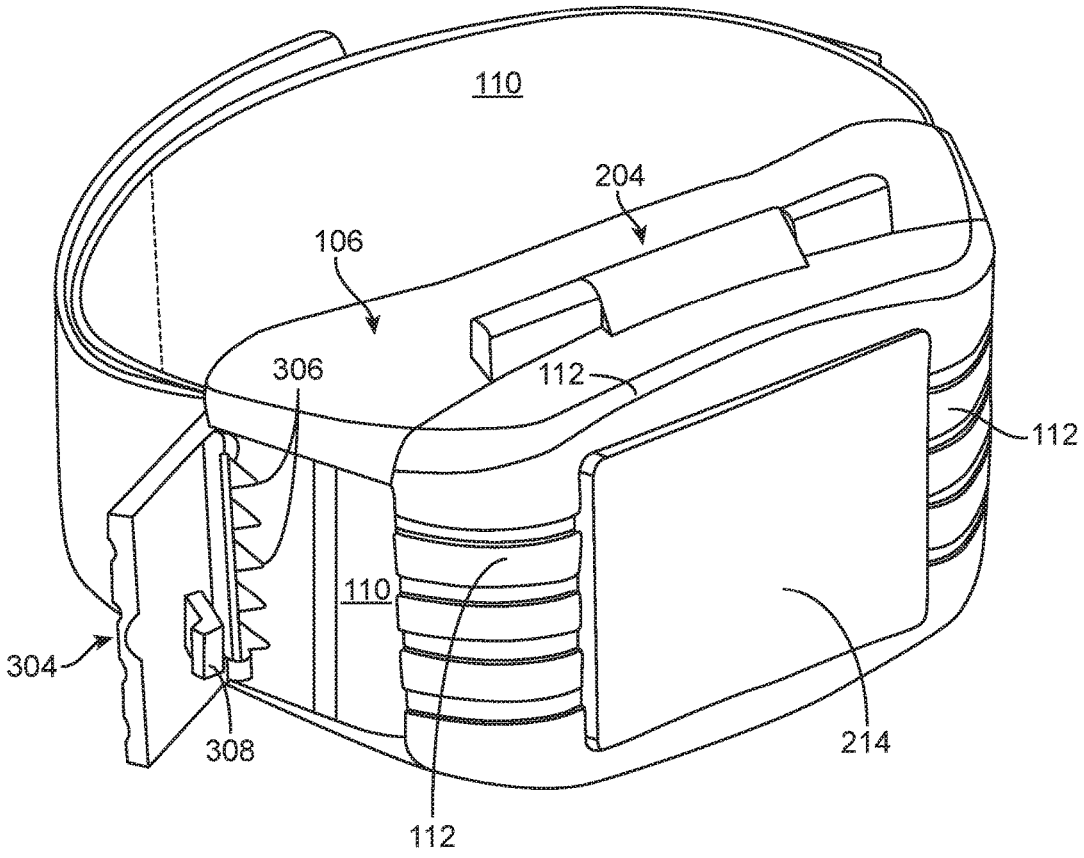
Figure 3D:
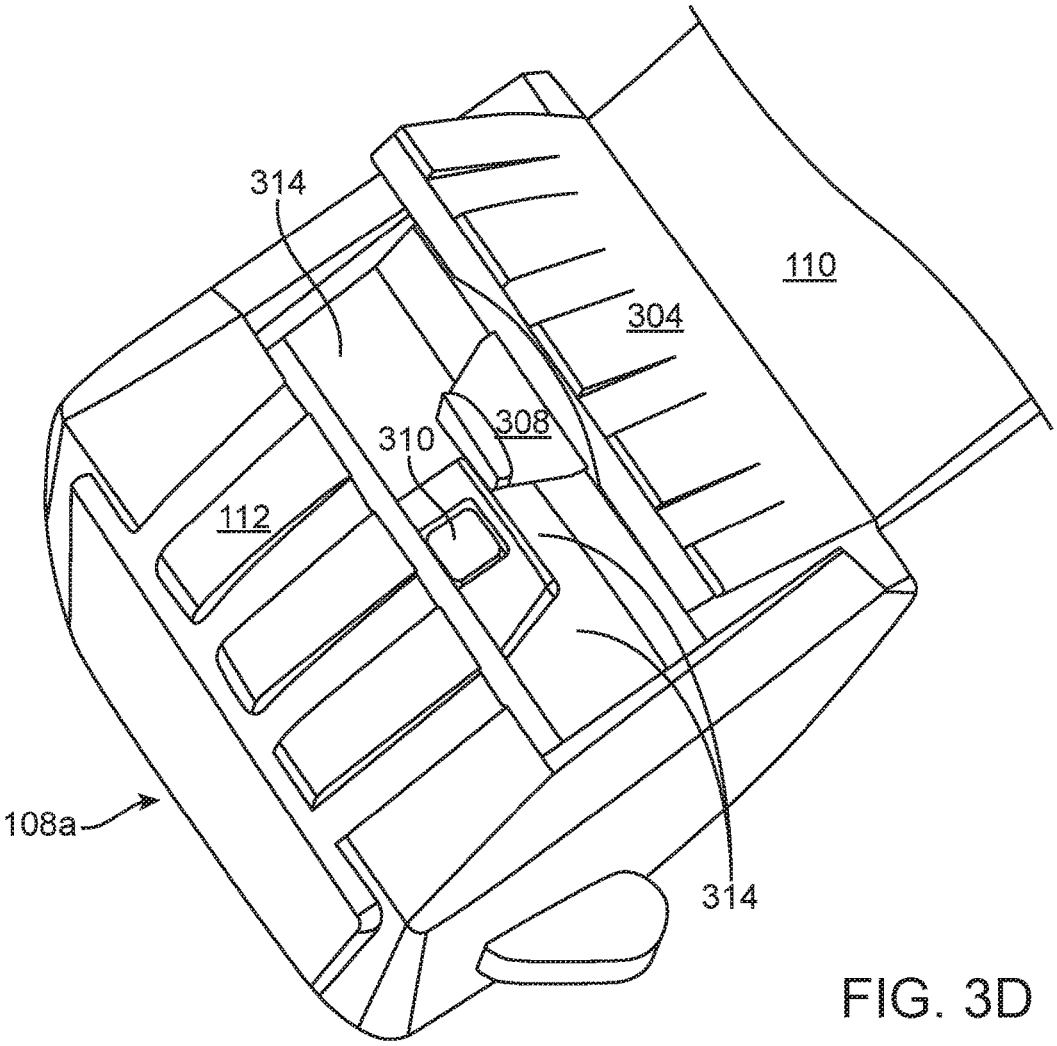
Figure 3E:
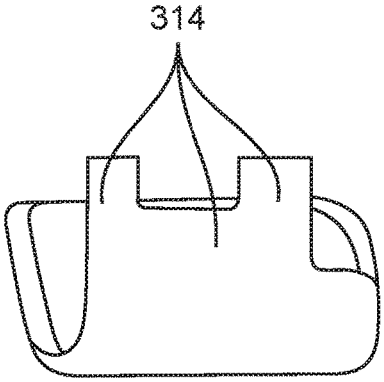
Figure 3F:
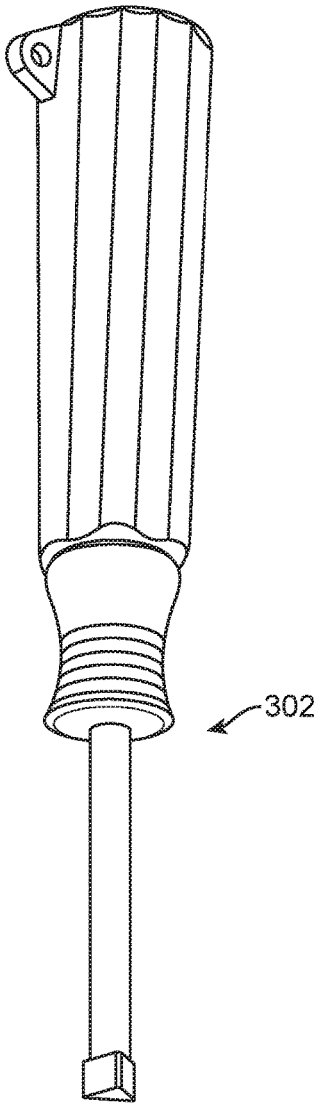

FIGS. 3A to 3F, are non-limiting exemplary illustrations of the various views of the apparatus for neutralizing anti-theft devices shown in FIGS. 1A to 2C, showing the locking mechanism in accordance with an embodiment of the invention. As illustrated, housing 106 includes a locking mechanism 212 that holds wearable support 110 at an adjusted fit, only to be loosened by an authorization device 302 (FIGS. 3A and 3F). In this non-limiting, exemplary instance, authorization device 302 is a key that unlocks the locking mechanism 212 for loosening the adjusted fit of wearable support 110 for removal of apparatus 100*a* from an authorized user.

Accordingly, once adjusted to a desired size of the user for a comfortable, tight fit, wearable support 110 is then locked in position by locking mechanism 212. Once the wearable support (in this non-limiting, exemplary instance a wristband) is tightened and secured to the user (e.g., a wrist of the user), it may be locked in that tight position by external key 302 (FIGS. 3A and 3F) so that apparatus 100*a* is always with the user and is only taken off when key 302 (which may be held by a manager) is used to unlock the lock mechanism 212 to loosen the tight grip of wearable support 110. This way, the users cannot remove apparatus 100*a* without authorized key 302. There are numerous ways to lock the desired size of the adjustable length of wearable support 110 to a desired position so that the user cannot remove it without unlocking. In this non-limiting, exemplary instance the locking mechanism 212 uses key device 302 (FIGS. 3A and 3F) to lock and unlock the apparatus from a user. It should be noted that although wearable support 110 is illustrated as a VELCRO® wristband, the material may be metal or other sturdy material and wearable support 110 may be other types such as a belt, lanyard, etc. Any wearable support 110 and lock mechanism 212 combination may be used so long as wearable support 110 is locked for a tight, yet comfortable fit with the users so that it is not taken off and removed without authorization.

As best illustrated in FIGS. 3B and 3C, the lock mechanism 212 is comprised of a locking door 304 that has a keeper 308 that engages with and interlocks with a latch or lock member 310 when the locking door 304 is in a closed position. The engagement and the interlocking of the locking door 304 to a locked position with the lock member 310 may be automatic when the locking door 304 is closed or, alternatively, the locking door 304 may be manually locked. For automatic locking, resilient members such as a spring may be used to automatically lock the locking door 304. For manual locking, locking door 304 is moved to a closed position and the lock member 310 is rotated along reciprocating path 312 by authorization device 302 to engage with and lock the keeper 308 in a locked position.

As indicated above, to unlock and open the locking door 304 from a closed, locked position (FIG. 3A) to a fully open, unlocked position (FIGS. 3B and 3C), cover 112 is first moved to an open position to allow access to lock mechanism 112 (and specifically, to lock member 310). Lock member 310 may then be rotated along path 312 using authorization device 302 to an unlock position where keeper 308 disengages from lock member 310 to thereby release locking door 304 to an open position. As further illustrated, locking door 304 includes grip members 306 that securely grip wearable support 110 to lock it at desired position. Accordingly, apparatus 100*a* is accounted for at all times, as it is lock-fit with the user.

As best illustrated in FIGS. 3D and 3E, housing 106 further includes a generally rigid security panel 314 that prevents tampering with locking member 310 of lock mechanism 212. Security panel 314 is positioned between lock member 310 of locking mechanism 212 and locking door 304, which partially blocks access to lock member 310 while locking door 304 is open.

FIGS. 4A to 4D are non-limiting exemplary illustrations of the various exploded views of the apparatus for neutralizing anti-theft devices shown in FIGS. 1A to 3F in accordance with one or more embodiments of the present invention. The exploded views illustrate the separated components and show their cooperative relationship in accordance with one or more embodiments of the present invention. Details of the components are further shown and described below and referenced back to FIGS. 4A to 4D.

Figure 4A:
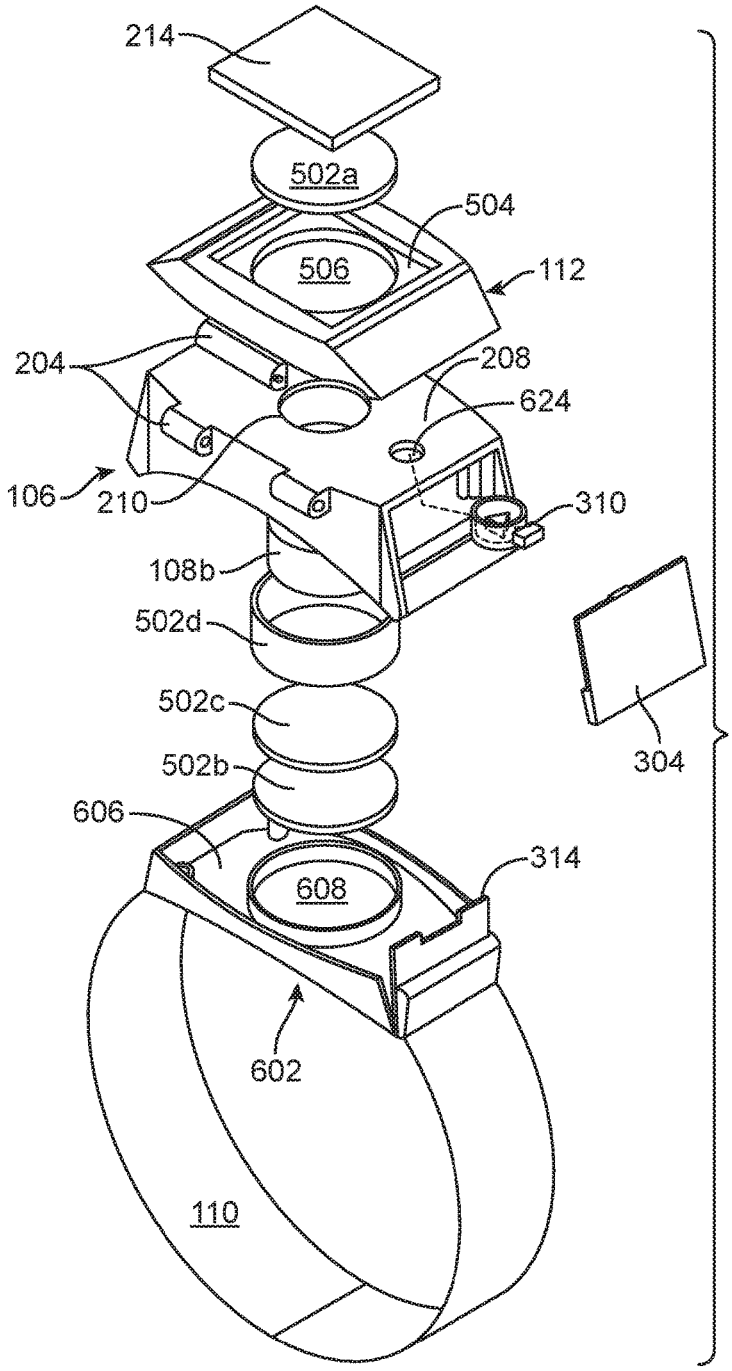
FIGS. 4A to 4D are non-limiting exemplary illustrations of the various exploded views of the apparatus for neutralizing anti-theft devices shown in FIGS. 1A to 3F in accordance with one or more embodiments of the present invention.
Figure 4B:
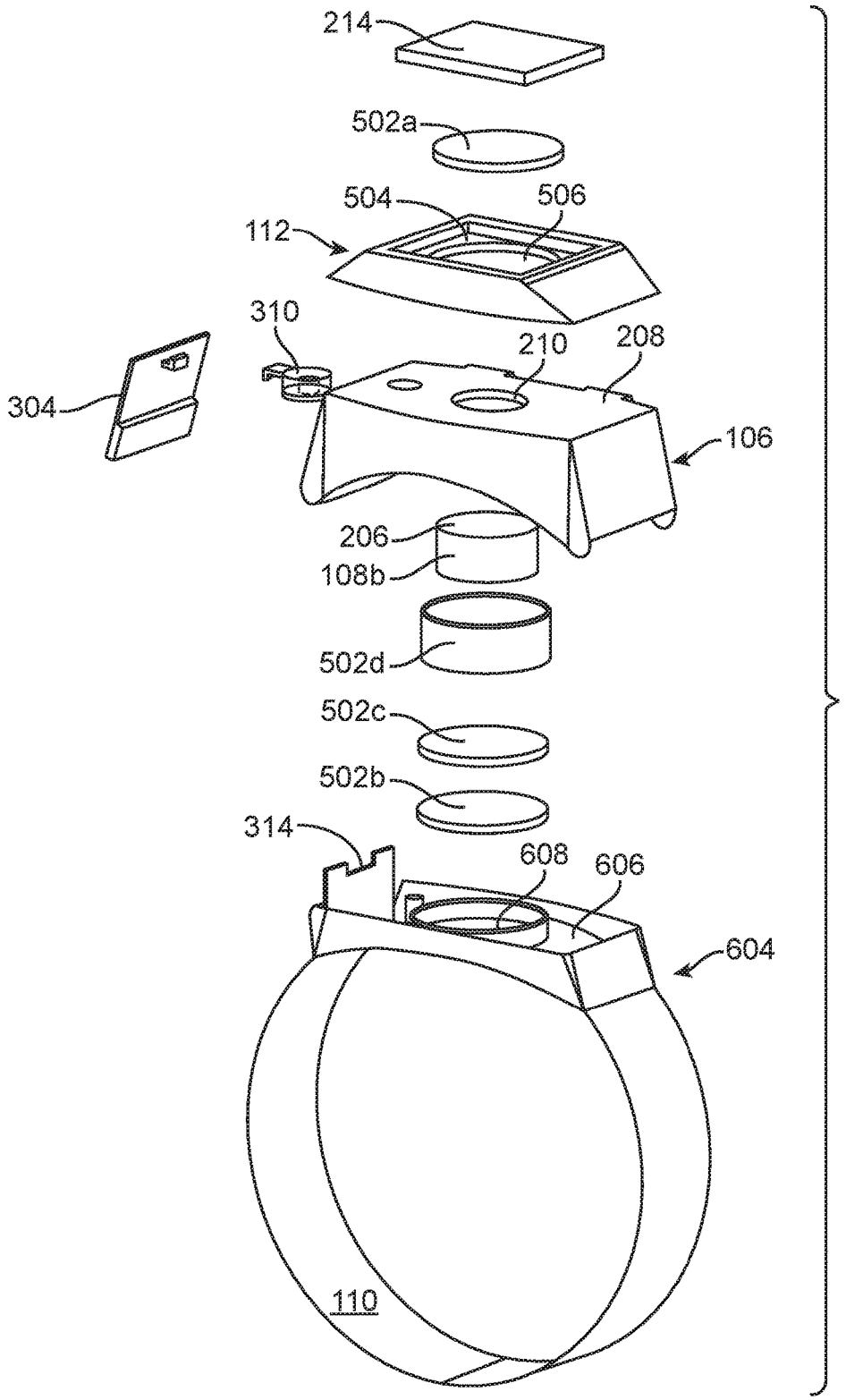
Figure 4C:
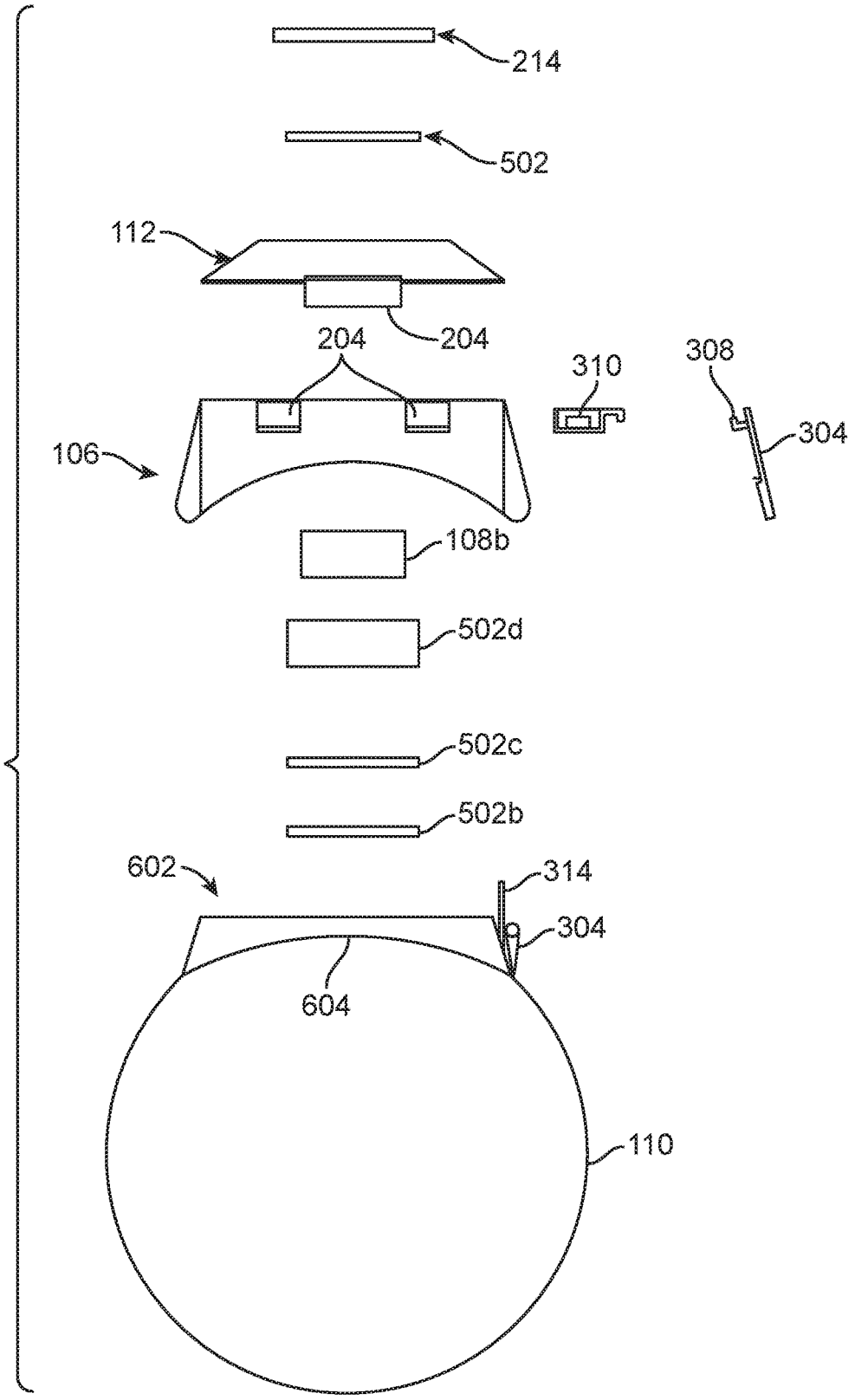
Figure 4D:
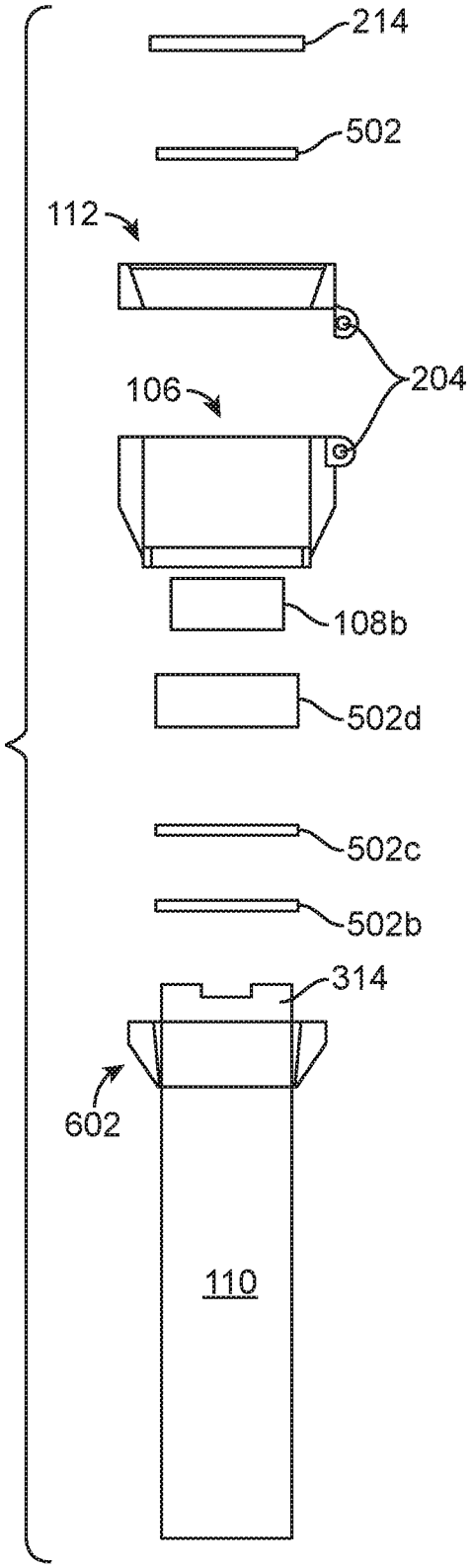
Figure 5:
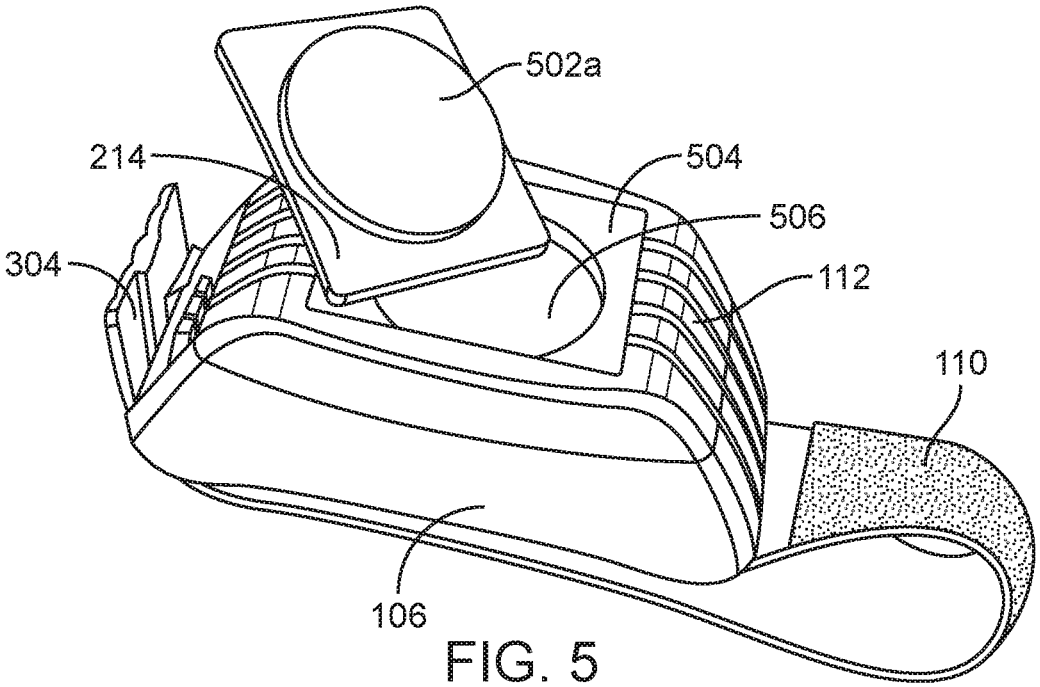
FIG. 5 is a non-limiting, exemplary illustration of an exterior portion of cover and one or more neutralizer assembly.

FIG. 5 is a non-limiting, exemplary illustration of an exterior portion of cover and one or more neutralizer member assembly. As illustrated in FIGS. 4A to 4D and detailed in FIG. 5, housing 106 is associated with cover 112 that accommodates one or more neutralizer 108 that are deactivators in a form of deactivator pad 214. The EAS deactivator pads are well known and conventional, a non-limiting example of which is disclosed in U.S. Pat. No. 5,920,262. Cover 112 accommodations for deactivator pad 214 includes a cavity comprised of compartments for housing a magnetic field shield 502 (e.g., a ferrous metal) and deactivator pad 214, which is positioned on an exterior top surface of cover 112, with deactivator the pad 214 accommodated within a first compartment 504. EAS deactivator pad 214 may be secured within compartment 504 by a variety of means, a non-limiting example of which may include use of simple adhesives such as a glue. As best illustrated in FIG. 3C, a top portion of EAS deactivator pad 214 protrudes out and extends above periphery walls of compartment 504 to allow full access to an engagement surface of EAS deactivator pad 214. The cavity further includes a second compartment 506 for housing a first shield 502*a*, which generally impedes and reduces engagement strength of one or more neutralizer 108*b* with objects. First shield 502*a* (and hence second compartment 506 for it) is optional and for safety only and therefore, the lack thereof would not affect the function of apparatus 100*a*.

FIGS. 6A to 6F are non-limiting exemplary illustrations of the various views of partially and fully disassembled apparatus shown in FIGS. 1A to 5 in accordance with one or more embodiments of the present invention. As illustrated in FIGS. 4A to 4D, and 6A and 6B, housing 106 includes a detachable enclosure 602 (in a non-limiting, exemplary form of an access panel) with an exterior facing side 604 that is configured and adapted for comfortable fit (e.g., smooth and concaved to comfortably fit the wrist). The detachable enclosure 602 is fastened to the housing 106 by a set of fasteners in the form of screws. An interior facing side 606 of detachable enclosure 602 includes a compartment 608 configured for securely accommodating one or more neutralizer 108*b* to thereby prevent a movement of the one or more neutralizer 108*b* within housing 106.

Figure 6A:
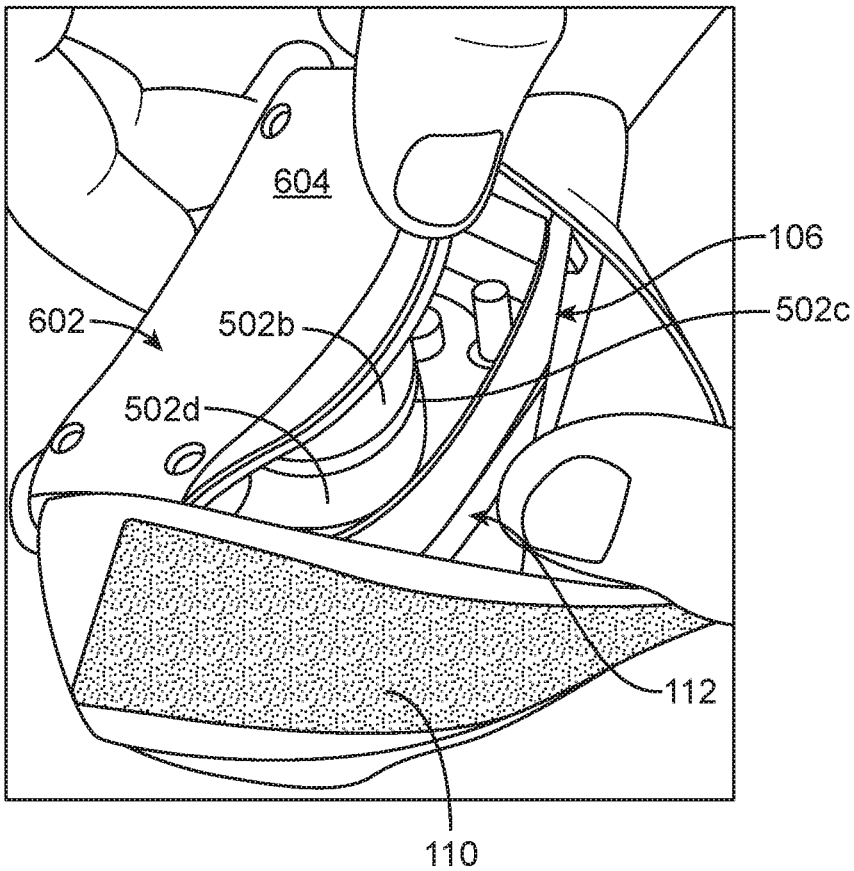
FIGS. 6A to 6F are non-limiting exemplary illustrations of the various views of partially and fully disassembled apparatus for neutralizing anti-theft devices shown in FIGS. 1A to 5 in accordance with one or more embodiments of the present invention.
Figure 6B:
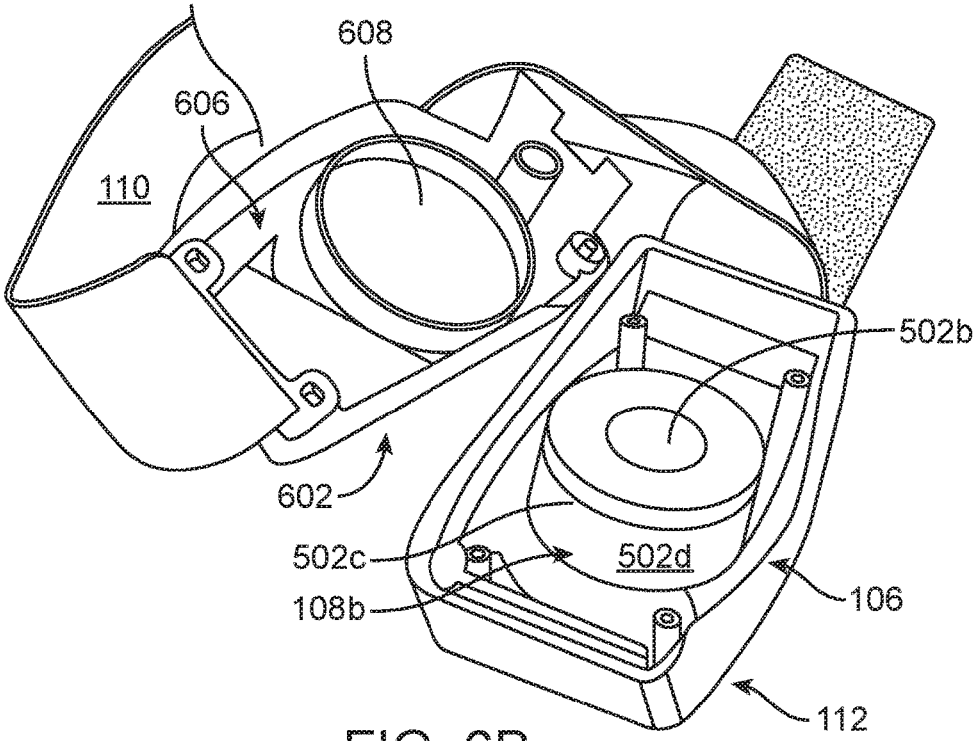
Figure 6C:
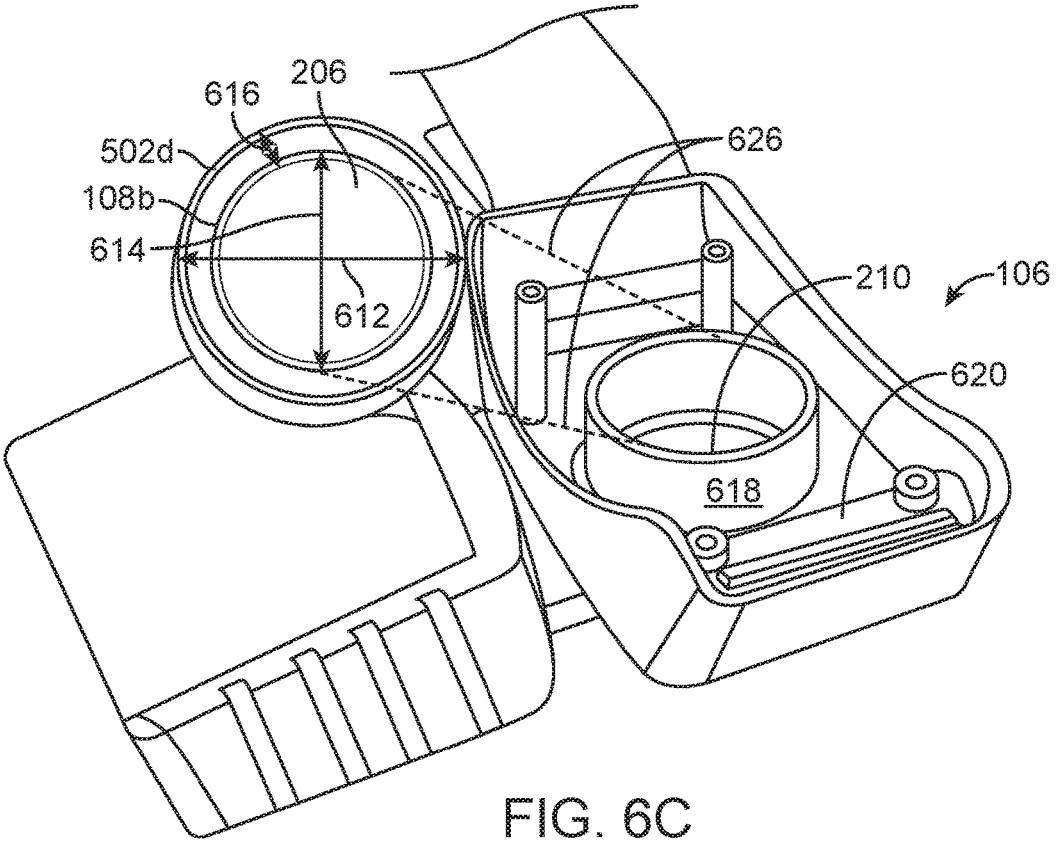
Figure 6D:
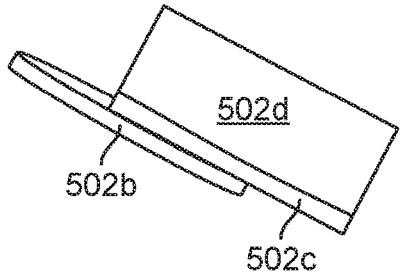
Figure 6E:
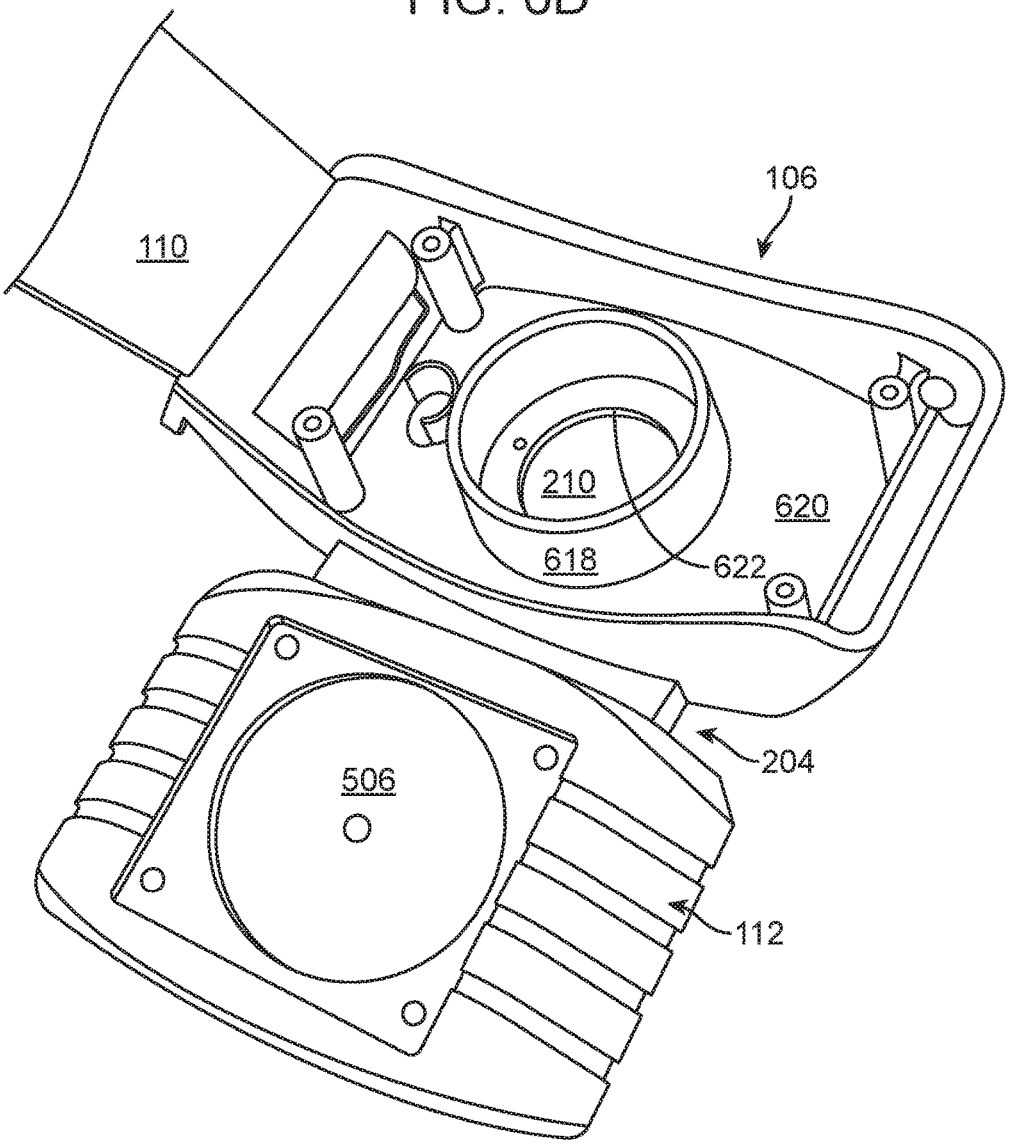

As illustrated in FIGS. 4A to 4D, and 6C and 6D, the one or more neutralizer 108*b* include at least one engagement surface 610 that is exposed and not associated with one or more magnetic shields 502, which generally restrict magnetic field of the one or more neutralizer 108*b* to a direction. The magnetic shields 502*b*, 502*c*, and 502*d* restrict the affects of the magnet field emanating from the magnets 108*b* to only one side 610. In other words, one or more magnetic shields 502 from all but one side 206 surround the one or more neutralizing member 108*b* (in a well-known and conventional manner), where that one open or free side constitutes the engagement surface 206 of the detacher 108*b*. In this non-limiting, exemplary instance, since neutralizer 108*b* is a cylindrically configured magnet, the shields 502*b* and 502*c* are discs that cover one side, and shield 502*d* is a hollow cylinder that surrounds the cylindrical side of neutralizer 108*b*. As best illustrated in FIG. 6C, cylindrical shield 502*d* has a diameter 612 that has a span that is longer than diameter 614 of neutralizer 108*b*, providing a gap 616 between neutralizer 108*b* and shield 502*d*, which as detailed below, is used to associate the entire neutralizer 108*b*/shield 502 assembly with housing 106.

Figure 6F:
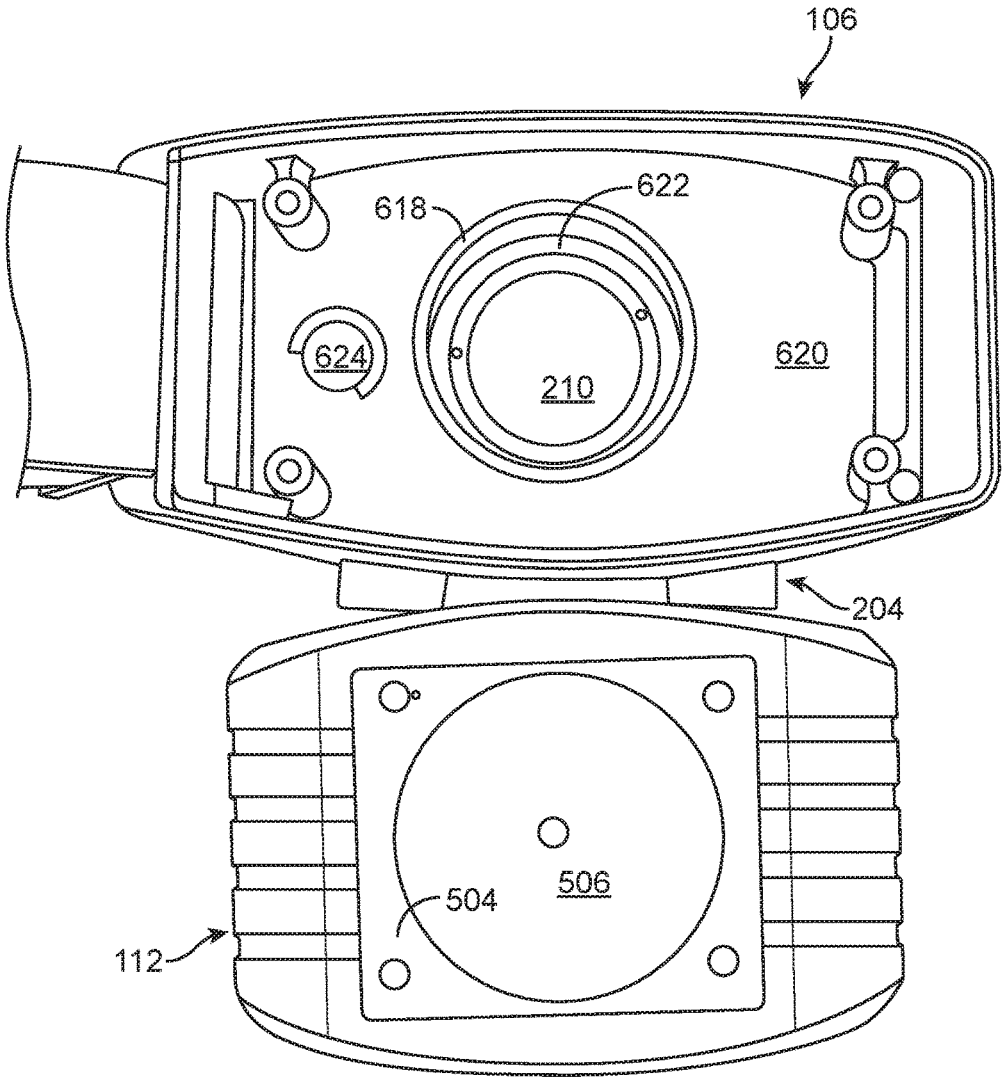

As further illustrated in FIGS. 4A to 4D and 6C to 6F, housing 106 includes top surface 208 that has a through-hole that constitutes an engagement opening 210 that exposes engagement surface 206 of one or more neutralizer 108*b*, allowing direct access to engagement surface 206. The through-hole includes a protruding securing member 618 that extends from an interior surface 620 of housing 106. Protruding securing member 618 surrounds engagement opening 210 as illustrated, and is inserted and positioned in gap 616 between magnetic shield 502*d* and neutralizer 108*b* (as illustrated by the dashed lines 626). Opening 210 is comprised of a retainer flange 622 that maintains neutralizer 108*b* from falling out of housing 106. As best illustrated in FIGS. 4A and 6F, interior surface 620 further includes a second opening 624 that accommodates lock member 310.

Figure 7:
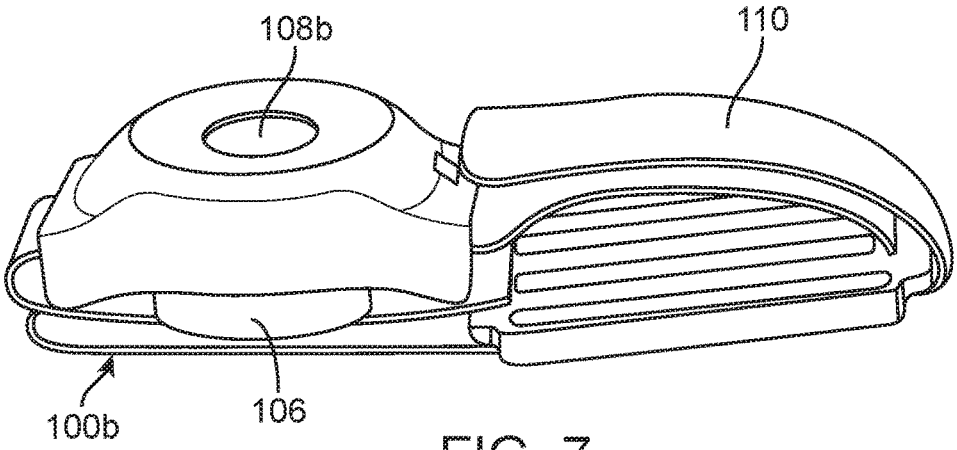
FIG. 7 is a non-limiting, exemplary illustration of an apparatus for neutralizing anti-theft devices in accordance with one or more embodiments of the present invention.

FIG. 7 is a non-limiting, exemplary illustration of an apparatus for neutralizing anti-theft devices in accordance with one or more embodiments of the present invention. Apparatus 100*b* illustrated in FIG. 7 includes similar corresponding or equivalent components, interconnections, functional, and or cooperative relationships as apparatus 100*a* that is shown in FIGS. 1A to 6F, and described above. Therefore, for the sake of brevity, clarity, convenience, and to avoid duplication, the general description of FIG. 7 will not repeat every corresponding or equivalent component, interconnections, functional, and or cooperative relationships that has already been described above in relation to apparatus 100*a* that is shown in FIGS. 1A to 6F. As illustrated in FIG. 7, apparatus 100*b* does not include a cover or a deactivator, but is comprised of detacher 108*b* that is accommodated within a wearable housing 106 with similar esthetic design to that of apparatus 100*a*.

Figure 8A:
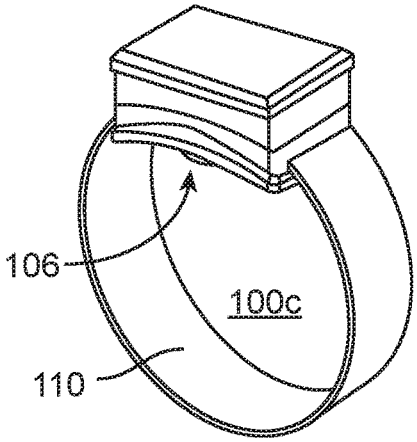
FIGS. 8A to 8C are non-limiting, exemplary illustrations of an apparatus for neutralizing anti-theft devices in accordance with one or more embodiments of the present invention.
Figure 8B:
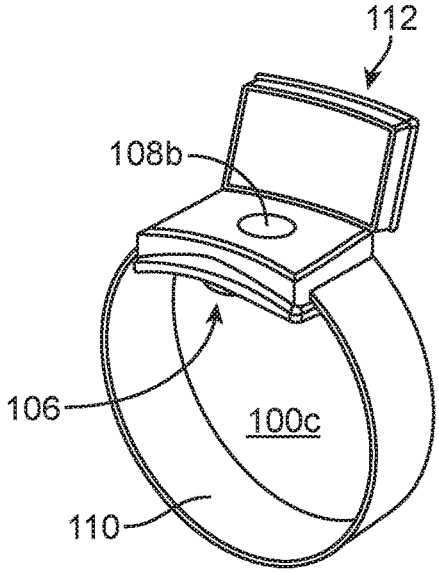
Figure 8C:
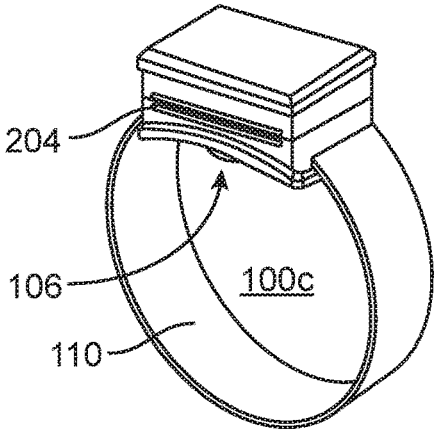

FIGS. 8A to 8C are non-limiting, exemplary illustrations of an apparatus for neutralizing anti-theft devices in accordance with one or more embodiments of the present invention. Apparatus 100*c* illustrated in FIGS. 8A to 8C includes similar corresponding or equivalent components, interconnections, functional, and or cooperative relationships as apparatuses 100*a* and 100*b* that are shown in FIGS. 1A to 7, and described above. Therefore, for the sake of brevity, clarity, convenience, and to avoid duplication, the general description of FIGS. 8A to 8C will not repeat every corresponding or equivalent component, interconnections, functional, and or cooperative relationships that has already been described above in relation to apparatuses 100*a* and 100*b* that are shown in FIGS. 1A to 7. As illustrated in FIGS. 8A to 8C, apparatus 100*c* does not include a deactivator, but is comprised of detacher 108*b* only, which is accommodated within a wearable housing 106 that includes a cover, with the apparatus 100*c* having similar esthetic design to that of apparatus 100*a*.

Figure 9A:
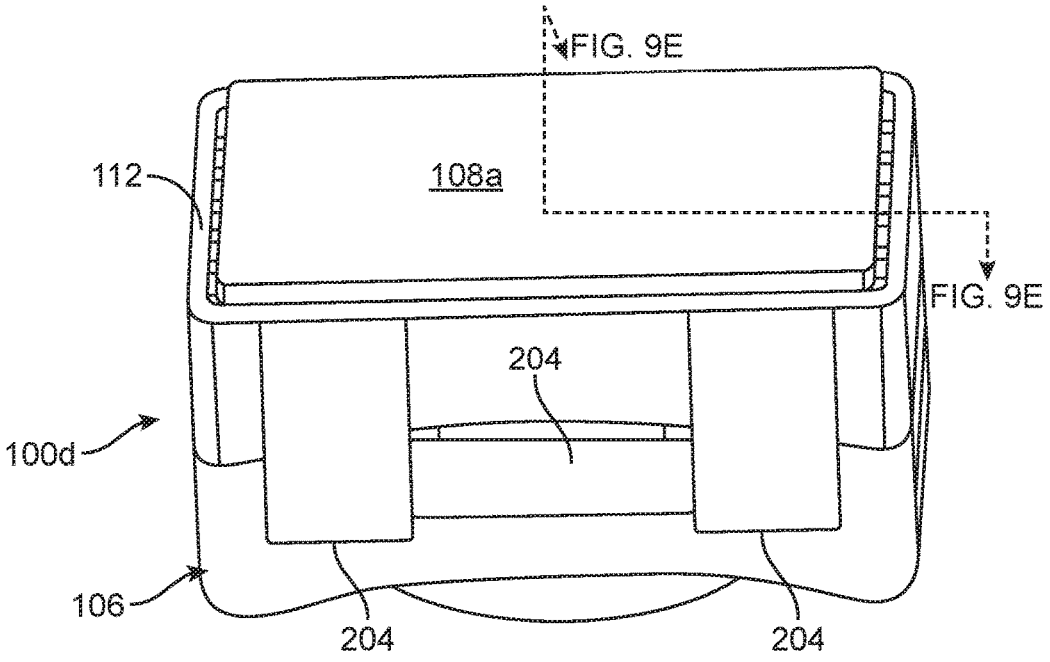
FIGS. 9A to 9E are non-limiting, exemplary illustrations of an apparatus for neutralizing anti-theft devices in accordance with one or more embodiments of the present invention.
Figure 9B:
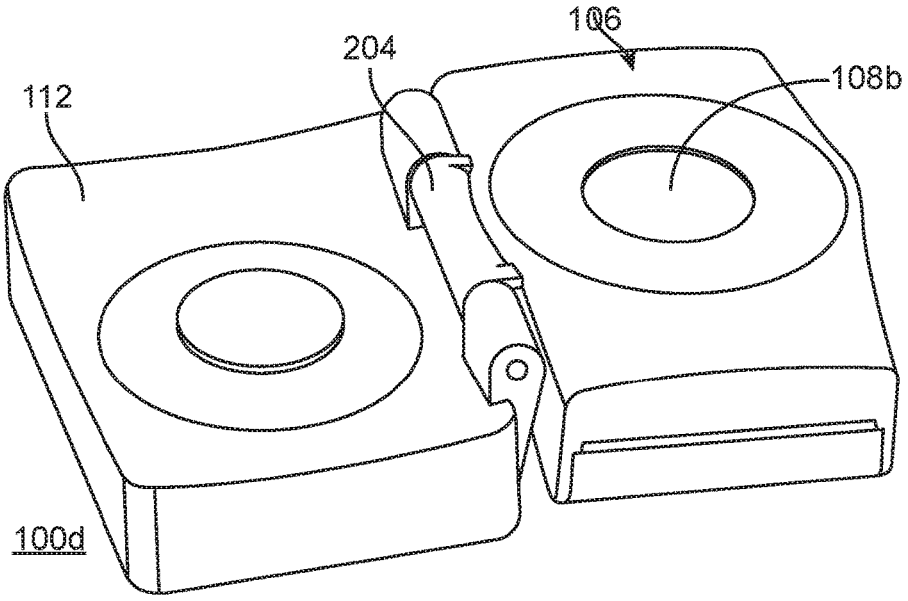
Figure 9C:
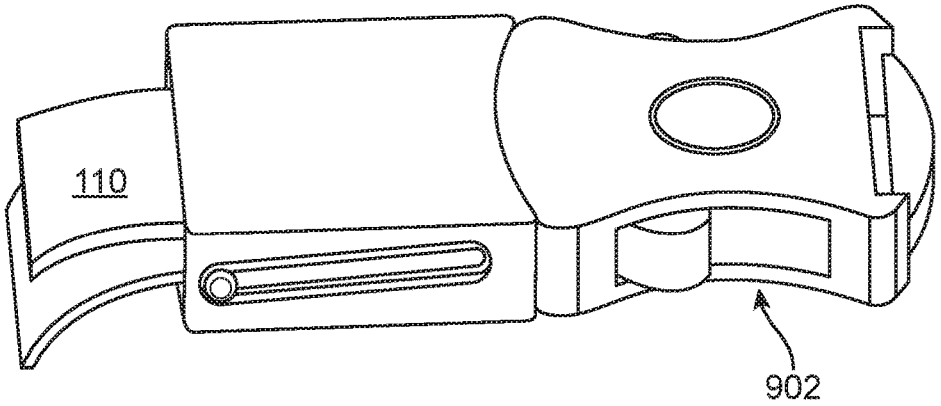
Figure 9D:
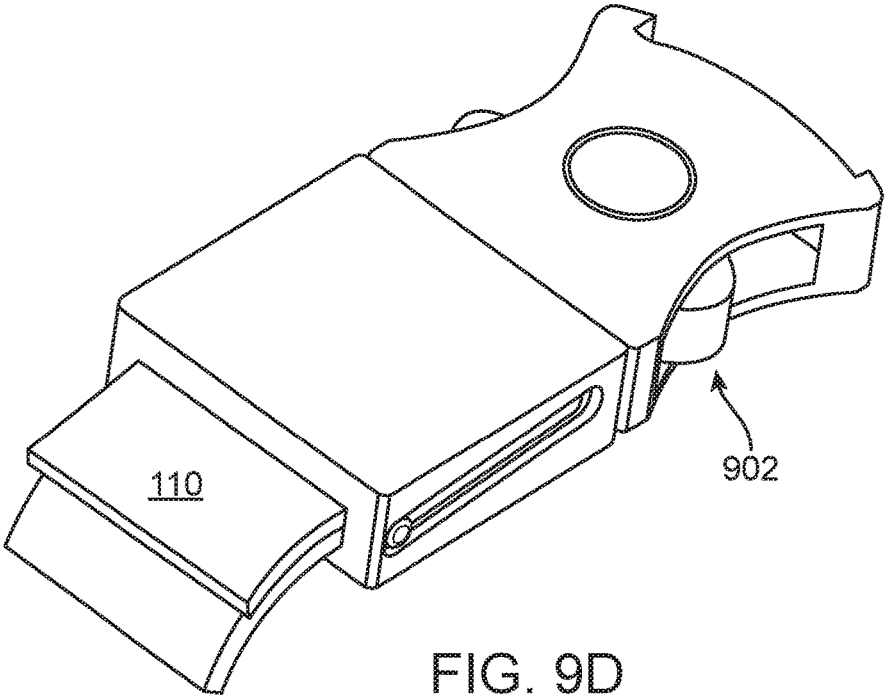
Figure 9E:
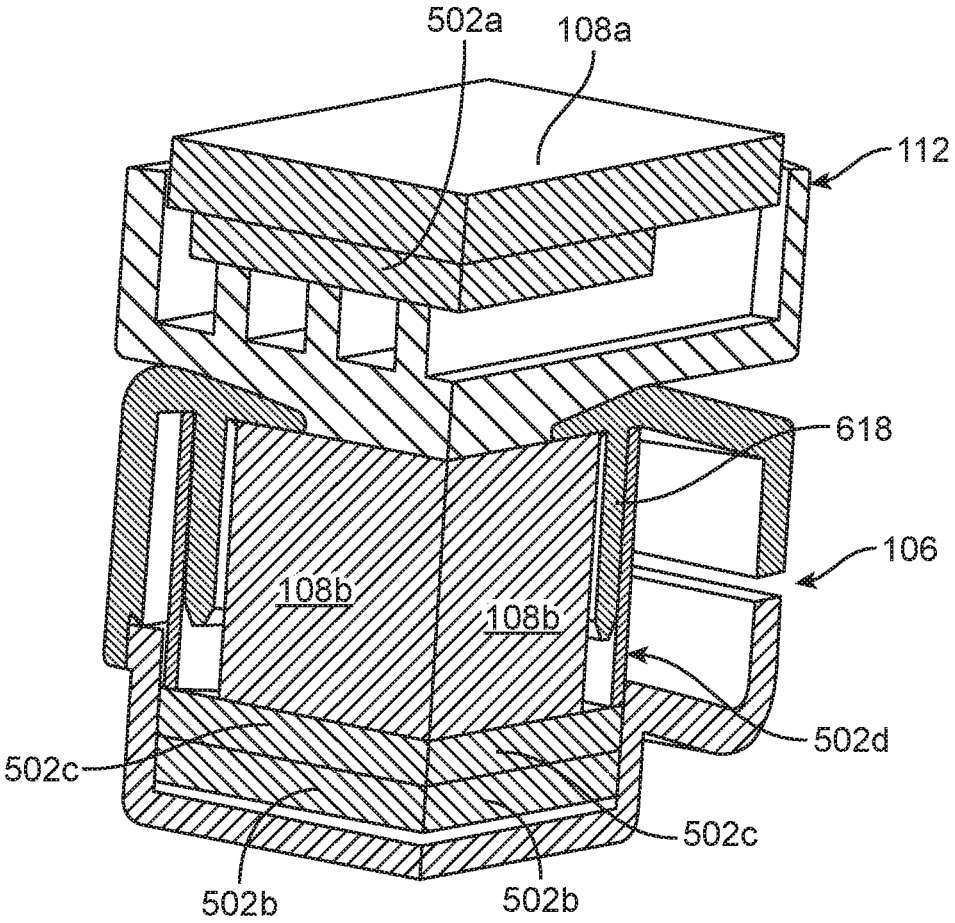

FIGS. 9A to 9E are non-limiting, exemplary illustrations of an apparatus for neutralizing anti-theft devices in accordance with one or more embodiments of the present invention. Apparatus 100*d* illustrated in FIGS. 9A to 9E includes similar corresponding or equivalent components, interconnections, functional, and or cooperative relationships as apparatuses 100*a*, 100*b*, and 100*c* that are shown in FIGS. 1A to 8C, and described above. Therefore, for the sake of brevity, clarity, convenience, and to avoid duplication, the general description of FIGS. 9A to 9E will not repeat every corresponding or equivalent component, interconnections, functional, and or cooperative relationships that has already been described above in relation to apparatuses 100*a*, 100*b*, and 100*c* that are shown in FIGS. 1A to 8C. As illustrated in FIGS. 9A to 9E, apparatus 100*d* includes a deactivator 108*a* and a detacher 108*b*, which are accommodated within a wearable housing 106 that accommodates the detacher 108*b* and has a cover 112 that accommodates deactivator 108*a*, with apparatus 100*d* having similar esthetic design to that of apparatus 100*a*. As illustrated in FIGS. 9C and 9D, in this non-limiting, exemplary instance, instead of using a VELCRO®, the present invention may also use a conventional latching buckle 902 to secure apparatus 100*d* with a user. Latch buckle 902 may be associated with any type of wearable support 110 such as a belt, wristband, etc. FIG. 9E exemplary illustrates a sectional view taken from FIG. 9A, which shows arrangement of shields 502 in relation to detacher 108*b* and deactivator 108*a*, similar to that described in relation to FIGS. 1A to 6F for apparatus 100*a*.

Although the invention has been described in considerable detail in language specific to structural features and or method acts, it is to be understood that the invention defined in the appended claims is not necessarily limited to the specific features or acts described. Rather, the specific features and acts are disclosed as exemplary preferred forms of implementing the claimed invention. Stated otherwise, it is to be understood that the phraseology and terminology employed herein, as well as the abstract, are for the purpose of description and should not be regarded as limiting. Further, the specification is not confined to the disclosed embodiments. Therefore, while exemplary illustrative embodiments of the invention have been described, numerous variations and alternative embodiments will occur to those skilled in the art. For example, the size and dimensions and the actual shapes of the various compartments, neutralizers 108, and or shields 502 may be varied dependent on many factors, non-limiting, non-exhaustive listing of examples of which may include the type of wearable support used for securing the apparatus 100 with a user. In general, the various compartments may also be varied commensurate with the shapes of the neutralizers 108 and or shields 502 being accommodated. Further, apparatus 100 may also be implemented with only a deactivator or only detacher. For example, if apparatus 100 is implemented to only include a deactivator such as a deactivator pad, then thin housing may be used to accommodate the pad with or without the user of a cover. Such variations and alternate embodiments are contemplated, and can be made without departing from the spirit and scope of the invention.

It should further be noted that throughout the entire disclosure, the labels such as left, right, front, back, top, bottom, forward, reverse, clockwise, counter clockwise, up, down, or other similar terms such as upper, lower, aft, fore, vertical, horizontal, oblique, proximal, distal, parallel, perpendicular, transverse, longitudinal, etc. have been used for convenience purposes only and are not intended to imply any particular fixed direction or orientation. Instead, they are used to reflect relative locations and/or directions/orientations between various portions of an object.

In addition, reference to "first," "second," "third," and etc. members throughout the disclosure (and in particular, claims) is not used to show a serial or numerical limitation but instead is used to distinguish or identify the various members of the group.

In addition, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of," "act of," "operation of," or "operational act of" in the claims herein is not intended to invoke the provisions of 35 U.S.C. 112, Paragraph 6.

What is claimed is:

1. An apparatus for neutralizing an anti-theft device, comprising:

one or more neutralizing member associated with a wearable support, forming a secured, wearable neutralizing apparatus that is mobile, for neutralizing an EAS anti-theft device; the wearable support is secured with the housing and adapted to be removable from a user by an authorization device.

2. The apparatus for neutralizing an anti-theft device as set forth in claim 1, wherein:

the one or more neutralizing member is accommodated within a housing that is associated with the wearable support.

3. The apparatus for neutralizing an anti-theft device as set forth in claim 1, wherein:

the one or more neutralizing member is a deactivator in a form of a deactivator pad that deactivates EAS devices.

4. The apparatus for neutralizing an anti-theft device as set forth in claim 1, wherein:

the one or more neutralizing member is a detacher in a form of a magnet that facilitate detachment and removal of EAS devices from articles.

5. The apparatus for neutralizing an anti-theft device as set forth in claim 1, wherein:

a first neutralizing member of the one or more neutralizing member is deactivator in a form of a deactivator pad; and a second neutralizing member of the one or more neutralizing member is a detacher in a form of a magnet.

6. The apparatus for neutralizing an anti-theft device as set forth in claim 1, wherein:

the wearable support is detachably secured with the housing.

7. The apparatus for neutralizing an anti-theft device as set forth in claim 1, wherein:

the authorization device is a key.

8. The apparatus for neutralizing an anti-theft device as set forth in claim 1, further comprising:

an electronic component.

9. The apparatus for neutralizing an anti-theft device as set forth in claim 8, wherein:

the electronic component is a Radio Frequency Identification (RFID) device.

10. The apparatus for neutralizing an anti-theft device as set forth in claim 2, wherein:

the housing includes a first compartment for securing a deactivator and a second compartment for securing a detacher.

11. The apparatus for neutralizing an anti-theft device as set forth in claim 10, wherein:

the first compartment is isolated from the second compartment.

12. An apparatus for neutralizing an anti-theft device, comprising: a housing for accommodating one or more neutralizing member; the housing associated with a wearable support, forming a secured, wearable neutralizing apparatus that is mobile, for neutralizing an EAS anti-theft device; the wearable support is secured with the housing and adapted to be removable from a user by an authorization device.

13. The apparatus for neutralizing an anti-theft device as set forth in claim 12, wherein:

the housing includes one or more compartment that accommodate the one or more neutralizing member.

14. The apparatus for neutralizing an anti-theft device as set forth in claim 12, wherein:

the one or more compartments are configured to expose an engagement surface of the one or more neutralizing member.

15. The apparatus for neutralizing an anti-theft device as set forth in claim 12, wherein:

a first compartment of the one or more compartments accommodates a first neutralizing member of the one or more neutralizing member.

16. The apparatus for neutralizing an anti-theft device as set forth in claim 14, wherein:

the first neutralizing member is one of a deactivator or a detacher.

17. The apparatus for neutralizing an anti-theft device as set forth in claim 12, wherein:

the wearable support is detachably secured with the housing.

18. The apparatus for neutralizing an anti-theft device as set forth in claim 12, further comprising:

an electronic component.

19. The apparatus for neutralizing an anti-theft device as set forth in claim 18, wherein:

the electronic component is a Radio Frequency Identification (RFID) device.

20. An apparatus, comprising: a housing for accommodating one or more neutralizer; the housing associated with a wearable support, forming a secured; wearable neutralizing apparatus that is mobile, for neutralizing an EAS anti-theft device; the housing is associated with a cover that accommodates one or more neutralizer that are deactivators in a form of a deactivator pad.

21. The apparatus as set forth in claim 20, wherein:

the housing is associated with a cover.

22. The apparatus as set forth in claim 20, wherein:

the housing is associated with a cover;

the cover in a closed position impedes and reduces an engagement strength of a direct engagement surface of the one or more neutralizer with objects by covering the engagement surface of the one or more neutralizer; and the cover in an open position enables access to the direct engagement surface of the one or more neutralizer.

23. The apparatus as set forth in claim 20, wherein:
cover accommodations for the deactivator pad includes a cavity comprised of a compartment for housing the deactivator pad.

24. The apparatus as set forth in claim 20, wherein:
the deactivator pad is positioned on an exterior top surface of the cover and accommodated within a first compartment.

25. The apparatus as set forth in claim 24, wherein:
a portion of the deactivator pad protrudes out and extends above a periphery walls of the first compartment to allow full access to an engagement surface of the deactivator pad.

26. The apparatus as set forth in claim 23, wherein:
the cavity further includes a second compartment for housing a shield, which generally impedes and reduces an engagement strength of one or more neutralizer with objects.

27. The apparatus as set forth in claim 20, wherein:
the housing includes a top surface that has an engagement opening that exposes an engagement surface of the one or more neutralizer, allowing direct access to the engagement surface.

28. The apparatus as set forth in claim 20, wherein:
the housing includes a locking mechanism that holds the wearable support at an adjusted fit, only to be loosened by an authorization device.

29. The apparatus as set forth in claim 28, wherein:
the authorization device is a key that unlocks the locking mechanism for loosening the adjusted fit of the wearable support for removal of the apparatus.

30. The apparatus as set forth in claim 20, wherein:
the housing includes a security panel the prevents tampering with a locking mechanism.

31. The apparatus as set forth in claim 30, wherein:
the security panel is positioned between a lock of the locking mechanism and a locking door of the lock mechanism, which partially blocks access to the lock while locking door is open.

32. The apparatus as set forth in claim 31, wherein:
the locking door includes members that securely grip the wearable support.

33. The apparatus as set forth in claim 31, wherein:
the locking door includes a keeper of the locking mechanism, which engages with the lock of the locking mechanism.

34. The apparatus as set forth in claim 20, wherein:
the housing includes a detachable enclosure with an exterior facing side that is configured and adapted for comfortable fit.

35. The apparatus as set forth in claim 20, wherein:
the housing includes a detachable enclosure with an interior facing side that has a cavity configured to securely accommodate the one or more neutralizers.

36. The apparatus as set forth in claim 20, wherein:
the one or more neutralizer include at least one engagement surface that is not associated with a shield.

37. The apparatus as set forth in claim 20, wherein:
the one or more neutralizer include at least one engagement surface that is not associated with shield to generally restrict an affect the one or more neutralizer to a direction.

38. The apparatus as set forth in claim 20, wherein:
the one or more neutralizer is surrounded by one or more shield from all but one side, with that one side constituting the engagement surface.

39. The apparatus as set forth in claim 20, wherein:
one or more neutralizer is associated with at least one shield with at least one side of the neutralizer.

40. The apparatus as set forth in claim 20, wherein:
the housing includes a through-hole constituting an engagement opening;
the through-hole includes a protruding surround that extends from an interior surface of a housing cavity, surrounding the engagement opening;
the through-hole further includes a flange that holds the one or more neutralizer within housing.

41. The apparatus as set forth in claim 20, wherein:
the housing includes a through-hole constituting an engagement opening;
the through-hole includes a protruding securing member that extends from an interior surface of a housing cavity, surrounding the engagement opening, with the protruding securing member positioned between a shield and a neutralizer of the one or more neutralizer.

42. The apparatus as set forth in claim 20, further comprising:
an electronic component.

43. The apparatus as set forth in claim 42, wherein:
the electronic component is a Radio Frequency Identification (RFID) device.

44. An apparatus, comprising: a housing for accommodating one or more neutralizer; the housing associated with a wearable support, forming a secured, wearable neutralizing apparatus that is mobile, for neutralizing an EAS anti-theft device; the housing includes a locking mechanism that holds the wearable support at an adjusted fit, only to be loosened by an authorization device.

45. An apparatus, comprising: a housing for accommodating one or more neutralizer; the housing associated with a wearable support, forming a secured, wearable neutralizing apparatus that is mobile, for neutralizing an EAS anti-theft device; the housing includes a detachable enclosure with an interior facing side that has a cavity configured to securely accommodate the one or more neutralizers.

46. An apparatus, comprising: a housing for accommodating one or more neutralizer; the housing associated with a wearable support, forming a secured, wearable neutralizing apparatus that is mobile, for neutralizing an EAS anti-theft device; the one or more neutralizer is surrounded by one or more shield from all but one side, with that one side constituting the engagement surface.

47. An apparatus, comprising: a housing for accommodating one or more neutralizer; the housing associated with a wearable support, forming a secured, wearable neutralizing apparatus that is mobile, for neutralizing an EAS anti-theft device; one or more neutralizer is associated with at least one shield with at least one side of the neutralizer.

48. An apparatus, comprising: a housing for accommodating one or more neutralizer; the housing associated with a wearable support, forming a secured, wearable neutralizing apparatus that is mobile, for neutralizing an EAS anti-theft device; the housing includes a through-hole constituting an engagement opening; the through-hole includes a protruding surround that extends from an interior surface of a housing cavity, surrounding the engagement opening; the through-hole further includes a flange that holds the one or more neutralizer within housing.

49. An apparatus, comprising: a housing for accommodating one or more neutralizer; the housing associated with a wearable support, forming a secured, wearable neutralizing apparatus that is mobile, for neutralizing an EAS anti-theft device; the housing includes a through-hole constituting an engagement opening; the through-hole includes a protruding securing member that extends from an interior surface of a housing cavity, surrounding the engagement opening, with the protruding securing member positioned between a shield and a neutralizer of the one or more neutralizer.

50. An apparatus, comprising: a housing for accommodating one or more neutralizer; the housing associated with a wearable support, forming a secured, wearable neutralizing apparatus that is mobile, for neutralizing an EAS anti-theft device; the housing is associated with a cover; the cover in a closed position impedes and reduces an engagement strength of a direct engagement surface of the one or more neutralizer with objects by covering the engagement surface of the one or more neutralizer; and the cover in an open position enables access to the direct engagement surface of the one or more neutralizer.

* * * * *